US006518225B1

(12) United States Patent
Fukutani et al.

(10) Patent No.: US 6,518,225 B1
(45) Date of Patent: Feb. 11, 2003

(54) LUBRICATING FLUID

(75) Inventors: Yasuo Fukutani, 252-7 Iba, Notogawa-Cho, Kanzaki-Gun, 521-1235 (JP); Kikuko Fukutani, 252-7 Iba, Notogawa-Cho, Kanzaki-Gun, 521-1235 (JP); Yukio Wada, Hikone (JP); Eiichiro Nakayama, Hikone (JP); Yoshiyuki Futahashi, Yokaichi (JP); Chiyo Wada, Yokaichi (JP); Naomi Kitagawa, Hikone (JP); Mie Fukutani, Kanzaki-Gun (JP); Kosuke Wada, Hikone (JP); Shinya Fukushima, Echi-Gun (JP); Sadayuki Futahashi, Yokaichi (JP); Yuko Okamoto, Kyoto (JP); Sadao Futahashi, Yokaichi (JP); Kazuma Suzuki, Tokyo (JP); Tamiko Tsuruta, Gifu (JP); Shunji Suzuki, Yokkaichi (JP); Hitohiro Fukutani, Higashiosaka (JP)

(73) Assignees: Yasuo Fukutani, Shiga (JP); Kikuko Fukutani, Shiga (JP)

( * ) Notice: Subject to any disclaimer, the term of this patent is extended or adjusted under 35 U.S.C. 154(b) by 0 days.

(21) Appl. No.: 09/673,432

(22) PCT Filed: Feb. 10, 2000

(86) PCT No.: PCT/JP00/00780 Jan. 4, 2001

(87) PCT Pub. No.: WO00/49113

PCT Pub. Date: Aug. 24, 2000

§ 371 (c)(1),
(2), (4) Date:

(30) Foreign Application Priority Data

Feb. 19, 1999 (JP) ..... 11-041837

(51) Int. Cl.[7] ..... C10M 173/02

(52) U.S. Cl. ..... 508/180; 508/583

(58) Field of Search ..... 508/180, 583

(56) References Cited

U.S. PATENT DOCUMENTS 4,406,812 A * 9/1983 Childers ..... 424/298
6,242,391 B1 * 6/2001 Fukutani et al. ..... 72/42
6,258,759 B1 * 7/2001 Futahashi et al. ..... 508/143

* cited by examiner

*Primary Examiner*—Jacqueline V. Howard
(74) *Attorney, Agent, or Firm*—Milde & Hoffberg, LLP

(57) ABSTRACT

The object of the present invention is to provide a water-base lubricating fluid or a water-base hydraulic fluid in place of an oily liquid which has been used as a lubricating oil or a hydraulic oil applied onto the operating part of a machine and a device. The lubricating fluid of the present invention comprises fluoride ion, hydrogencarbonate ion, and water-soluble alcohols or their derivatives.

4 Claims, No Drawings

LUBRICATING FLUID

This application is a 371 of PCT/JP00/00780 Feb. 10, 2000.

FIELD OF THE INVENTION

The present invention relates to a novel lubricating fluid which may supersede a lubricating oil used for a machine and a device or a hydraulic oil used for a cylinder, or the like.

BACKGROUND OF THE INVENTION

A lubricating oil is sent into a rotation part or a slide part of a machine or a device by a pump and the like, and prevents a sliding part from being burnt while reducing resistance caused by a rotation and a slide. In ordinary cases, when a machine or a device, for example, a machine tool such as a lathe, a milling cutter or a machining center or the like, is used for cutting or grinding a workpiece, a cutting oil or the like is flowed down over the part to be machined for various purposes. The spread cutting oil splashes on a bearing and a slide part of a bed, which results in mixing the lubricating oil and the cutting oil. Therefore, lubricating oils are retrieved as part of cutting oils and recycled while the lubricating oils are newly refilled.

Since waste oil problems are raised when these oils are disposed, and a volatile and transpiratory gas emitted from the cutting oils has the risk of impairing the health of workers as well as deterioration of working environment, water-base cutting fluids are expected and various kinds of water-base cutting fluids have been proposed. However, when a water-base cutting fluid is used, for example, in a machine tool, the lubricating oil used in the machine tool flowing into the cutting fluid makes an oil film appear on the surface of the cutting fluid and leads to the solidification of the lubricating oil. Consequently, the machine itself has the risk of being adversely affected because the cutting fluid is circulated in the machine. Further, when the cutting fluid is disposed, it is necessary to separate the lubricating oil from the cutting fluid. The task is difficult, so that it has cost higher than one using a cutting oil.

The use of a water-base lubricating fluid with a corresponding water-base cutting fluid, therefore, causes no problems, even if the lubricating fluid has been mixed with the cutting fluid. In addition, any problems, such as separation of oil and water, or the like are not raised when the waste liquid is disposed. However, there have been no water-base lubricating fluids, because when a water-base lubricating fluid is used in a machine tool such as an expensive machining center and the like, there are not only problems with rust, but also the risk that a lot of resistance may be applied onto a high-speed rotating driving part and a heavily loaded base part in the process of cutting, which leads to the risk of seizure.

Furthermore, hydraulic oils used for operating devices, such as cylinders, or the like are conventionally oily. Describing this by exemplifying a cylinder used for a bulldozer, or the like, for example, it is important not only to operate a piston by supplying oil for a cylinder, but also to prevent the cylinder from seizure, even when a heavy load is applied. For this reason, there has been no choice but to use oil-base hydraulic oils. Although water is used as a hydraulic fluid in the field of press working and the like, there have not been such types that are used by circulating a hydraulic fluid between the press and the tank.

The object of the present invention is to provide a water-base lubricating fluid or a hydraulic fluid in place of an oil-base fluid which has been used as a lubricating oil or a hydraulic oil applied onto the operating portion of a machine and a device.

As the result of repeated studies to develop an excellent lubricating fluid having high lubricating effects without any problems with its waste fluid disposal, the inventors of the present invention have attained the present invention.

DISCLOSURE OF THE INVENTION

It is the main point of a lubricating fluid according to the present invention to comprise fluoride ion; hydrogencarbonate ion; and water-soluble alcohols or their derivatives. The term "lubricating fluid" as used herein means a hydraulic fluid and the like used for operating a driving device such as a cylinder, or the like as well as a lubricating fluid used for lubricating a sliding part of a machine element.

In such lubricating fluid, the above-mentioned water-soluble alcohols or their derivatives may be glycerin or ethylene glycol.

Such lubricating fluid further contains a rust inhibitor.

DESCRIPTION OF THE PREFERRED EMBODIMENTS

The embodiment of a lubricating fluid according to the present invention will now be described in detail. First, the lubricating fluid according to the present invention comprises fluoride ion; hydrogencarbonate ion; and water-soluble alcohols or their derivatives.

The essential components contained in the lubricating fluid of the present invention are fluoride ion; hydrogencarbonate ion; and water-soluble alcohols or their derivatives. The concentration of fluoride ion and hydrogencarbonate ion is not particularly limited, but the lubricating fluid preferably contains within the range of $1\times10^{-3}$ to 10% by weight of fluoride ion, and within the range of $1\times10^{-2}$ to 10% by weight of hydrogencarbonate ion. Of the water-soluble alcohols or their derivatives, glycerin, ethyl alcohol, methyl alcohol, and ethylene glycol or their derivatives, or the like are preferable. Among them, glycerin or ethylene glycol or its derivative is particularly preferable. The concentration of glycerin and ethylene glycol or its derivative included in the lubricating fluid is not particularly limited, but it is preferably within the range of 1 to 70% by weight, more preferably within the range of 2 to 60% by weight.

Accordingly, the lubricating fluid of the present invention can be prepared by dissolving, for example, a predetermined amount of sodium bicarbonate, sodium fluoride, and ethylene glycol in distilled water and service water or mineral water or the like, but the manner is not limited. Sodium ion may particularly be substituted by one of other alkali metal ions or other cations.

The lubricating fluid of the present invention may be used alone, but it may further include other additives. A typical example of other additives is a rust inhibitor. It is, however, not limited to a rust inhibitor, but a suitable amount of thickener, leveling agent, colorant, and perfume may be added to the lubricating fluid in accordance with the actual service condition within the scope of keeping its performance.

The rust inhibitor used in the present invention may be any of rust inhibitors available in the market. For example, an ion coating rust inhibitor, a rust inhibitor including such as paraffin wax, carnauba wax, and the like, and a non-amine rust inhibitor, or the like are preferably used. The rust inhibitor is added as necessary in some applications to the lubricating fluid described in this patent application.

The lubricating fluid of the present invention can be obtained by mixing and/or dissolving fluoride ion, hydrogencarbonate ion, water-soluble alcohols or their derivatives, and other arbitrary components into water or other water-soluble solvent within the scope of the appropriate concentration.

The present invention relates to a lubricating fluid including the above-mentioned composition, wherein the surface of a steel product or the like is protected by coating the product by fluoride ion, hydrogencarbonate ion and/or a water-soluble alcohol, moreover, the sliding resistance between members of the product is reduced by lowering the friction factor. As a result, when the members are slid each other, there is no possibility of their contact surfaces seizing, even if the pressure applied onto the surfaces between both members gets higher due to heavy load.

Further, for example, when the lubricating fluid is used in a machine tool as the water-base cutting fluid, the lubricating fluid and the cutting fluid are not separated, even if they have been mixed because this lubricating fluid is water-base. Especially, the lubricating fluid of the present invention has no risk of river contamination caused by special liquid waste disposal because it comprises of inorganic components existing in nature.

The lubricating fluid according to the present invention may also be used on any place where either of an axial load or a thrust load is applied. Consequently, the lubricating fluid can be used not only as a lubricating fluid for a wide variety of machine tools, but also as a lubricating fluid in sequential feeding system using a pump or the like.

Furthermore, the lubricating fluid according to the present invention can be used as a hydraulic fluid in place of a conventional hydraulic oil or hydraulic water for an oil hydraulic cylinder and a hydraulic cylinder. Particularly, the lubricating fluid of the present invention is the most suited to be used as a hydraulic fluid for a cylinder on which a heavy load is applied, such as a power shovel or a bulldozer, because the lubricating fluid reduces frictional resistance. It is needless to say that the lubricating fluid can be used as a hydraulic fluid for a hydraulic equipment.

The present invention will now be described in more detail by showing the following examples. The present invention is, however, not limited to these examples. The invention can be embodied by adding a variety of improvements, modifications, and changes, based on knowledges of those skilled in the art within a scope that does not depart from the essentials of the invention.

EXAMPLES

Example 1

0.8 g of sodium fluoride (made by ARAKAWA CHEMICAL INDUSTRIES, LTD.), 3.9 g of sodium hydrogencarbonate (made by WAKO PURE CHEMICALS INDUSTRIES, LTD.), 51 ml of ethylene glycol (made by ARAKAWA CHEMICAL INDUSTRIES, LTD.; specific gravity 1.1155), 1929 ml of glycerin (made by ARAKAWA CHEMICAL INDUSTRIES, LTD.), a 185 ml-rust inhibitor F2 (made by CHELEST CORPORATION), and a 1 ml-preservative (CHIYODA CHEMICAL CO., LTD.) were dissolved in 1 L of distilled water to prepare a lubricating fluid (3170 ml (1.169 g/ml)).

An endurance test on a machine tool was conducted by using the lubricating fluid of the present invention obtained in this manner. First, a lubricating oil was removed not only from the driving and sliding parts of a machining center (made by MORI SEIKI CO., LTD., TV-400-497), and the lubricating oil tank. Then, a lubricating fluid of the present invention obtained instead of the lubricating oil was supplied in a lubricating tank and the pump was driven so that the lubricating fluid may fully spread over each part, such as a bed. After that, the machine sat no-load running to be confirmed each part moved smoothly. Next, the following steps of machining from (1) to (5) were repeated. Note that a water-base cutting fluid having a close component structure to that of the lubricating fluid of the present invention was used.

(1) A plate material SS400 (300×100×30 mm) was mounted on the machine to cut its surface with a machining allowance of 0.5 mm and a finishing allowance of 0.2 mm using a face mill (made by SANDVIK, CoroMill 245, tool diameter 80.0 mm). More particularly, the roughing of the plate (depth of cut: 0.3 mm, width of cut: 60.0 mm, speed of rotation: 450 rpm, and feed rate: 280 mm/min) was performed, a finishing was carried out (depth of cut: 0.1 mm, width of cut: 60.0 mm, speed of rotation: 580 rpm, and feed rate: 360 mm/min).

(2) A hole was drilled on the plate used in the step (1) to an effective depth of 10.0 mm. More particularly, a center drill (made by YAMAWA, CD-E 1.5×60°, tool diameter 1.5 mm) was used to drill a hole under the conditions of cycle: drill, speed of rotation: 2000 rpm, and feed rate: 200 mm/min. Subsequently, the operation of drilling a hole with a prepared hole drill Wade by OSG, EX-SUS-GDS 2.6, tool diameter 2.5 mm) is repeated under the conditions of cycle: high speed depth, speed of rotation: 3180 rpm, and feed rate: 320 mm/min until 189 pieces of holes, which were the total of 7×27, were drilled.

(3) The plate used in the step (2) was replaced with a plate material AL5052 (300×100×30 mm), and then the surface of the plate was cut with a machining allowance of 0.2 mm and a finishing allowance of 0.2 m using an end mill (made by OSG, V-XPM-EMS 20, tool diameter 20.0 mm). More particularly, the roughing of the plate (depth of cut: 0.0 mm, width of cut: 10.0 mm, speed of rotation: 1240 rpm, and feed rate: 350 mm/min) was performed, and then a finishing (depth of cut: 0.1 mm, width of cut: 10.0 mm, speed of rotation: 1610 rpm, and feed rate: 450 mm/min) was carried out.

(4) The plate used in the step (3) was replaced with a plate material SUS304 (300×100×30 mm), and then the surface of the plate was cut using an end mill (made by OSG, V-XPM-EMS 20, tool diameter 20.0 mm) with a machining allowance of 0.2 mm and a finishing allowance of 0.2 mm. More particularly, the roughing of the plate (depth of cut: 0.0 mm, width of cut 6.0 mm, speed of rotation: 300 rpm, and feed rate: 60 mm/min) was performed, and then a finishing (depth of cut: 0.1 mm, width of cut: 6.0 mm, speed of rotation: 390 rpm, and feed rate: 80 mm/min) was carried out.

(5) After a prepared hole was drilled on the plate used in the step(4) to an effective depth of 7.0 mm, chamfering was accomplished (type: Metric, width of chamfer: 0.3 mm). And then, an internal thread (nominal diameter: 3.0 mm, pitch: 0.5 mm) was cut on the hole. More particularly, a hole was drilled with a center drill (made by YAMAWA, CD-E 1.5×60°, tool diameter 1.5 mm) under the conditions of cycle: drill, speed of rotation: 1400 rpm, feed rate: 160 mm/min, and then a hole was drilled on the hole with a prepared hole drill (made by OSG, EX-SUS-GDS 2.6, tool diameter 2.5 mm) under the conditions of cycle: deep hole, speed of rotation: 1910 rpm, and feed rate: 130 mm/min. After that, chamfering was accomplished with a chamfering drill (made by OSG, TIN-NC-LDS 6×90°) under the conditions of cycle: drill D, speed of rotation: 2670 rpm, and feed rate: 160 mm/min. Next, an internal thread was cut on the hole with a tap (made by OSG, EX-SUS-SFT m3×0.5, tool diameter: 3.0 mm) under the conditions of cycle: synchronous stop, speed of rotation: 1170 rpm, and feed rate: 0.5 mm/min. The above-mentioned step was repeated until the total of 189 pieces of internal threads summing up 7×27 were formed.

The above-mentioned steps from (1) to (5) were repeated. And inspections as necessary for abnormalities on each part of the machining center were made when a machine is stopped to be exchanged workpieces. As a result, no abnormalities occurred in an operation test for the total number of 800 hours (results obtained by the day before the patent application). Although the lubricating fluid was refilled during the period of the operation test, no abnormalities were encountered in the machining center as well as in both tanks for the lubricating fluid and the cutting fluid.

Example 2

With the use of a centrifugal pump (made by NISHIJIMA SEISAKUSHO, EC40=28), the above obtained lubricating fluid was charged onto the bearing part of the pump. A day and night continuous operation test was performed for the total number of 2472 hours (results obtained by the day before the patent application). However, no abnormalities were encountered because the situation was completely same at the commencement of operation through the operation test.

Example 3

With the use of a mini-power shovel (made by KOMATSU LTD. on Dec. 15, 1985, PC-20, type 5), the above obtained lubricating fluid was charged instead of the hydraulic oil supplied with cylinders for the power shovel and change-direction. No abnormalities were encountered because the situation was completely same as the time of commencement, even after an operation test of movement with a travel and a turn between the parking place and the workplace, as well as hole digging for the total number of 505 hours (results obtained by the day before the patent application). In addition, no abnormalities were encountered, even when the power shovel was operated by immediately starting of an engine and change-direction after leaving the power shovel under the environment at an outside air temperature below −6° C. for more than 10 hours during the period of this operation test.

INDUSTRIAL APPLICABILITY

As described above, the lubricating fluid of the present invention has no risk of seizing up of components because of its high lubricating effects and low viscosity which reduce the frictional sliding resistance.

Since the lubricating fluid of the present invention does not contain any components which emit an offensive odor as volatile and transpiratory compositions, and contaminate the environment, the fluid is easy to use and environmentally friendly. Further, no special wastewater treatment is required for the lubricating fluid, even when the fluid is disposed as a waste fluid because it does not contain any materials adversely affecting the environment. Further, the lubricating fluid of the present invention can be used together with a water-base cutting fluid because of its water-base characteristics so that both of the effects of the lubricating fluid and the cutting fluid synergistically contribute to workability and environmental friendliness.

What is claimed is:

1. A lubricating fluid comprising:

water; fluoride ion; hydrogencarbonate ion; and water-soluble alcohols or their derivatives.

2. The lubricating fluid according to claim 1, wherein said water-soluble alcohols or said derivatives are glycerin or ethylene glycol.

3. The lubricating fluid according to claim 1, which further contains a rust inhibitor.

4. The lubricating fluid according to claim 2, which further contains a rust inhibitor.

* * * * *